United States Patent [19]

Mima

[11] Patent Number: 4,671,053

[45] Date of Patent: Jun. 9, 1987

[54] YARN SPLICING NOZZLE UNIT

[75] Inventor: Hiroshi Mima, Joyo, Japan

[73] Assignee: Murata Kikai Kabushiki Kaisha, Kyoto, Japan

[21] Appl. No.: 849,886

[22] Filed: Apr. 9, 1986

[30] Foreign Application Priority Data

Apr. 12, 1985 [JP] Japan ..... 60-78889

[51] Int. Cl.[4] ..... D01H 15/00

[52] U.S. Cl. ..... 57/22

[58] Field of Search ..... 57/22, 261, 262, 263

[56] References Cited

U.S. PATENT DOCUMENTS

| | | | |
|---|---|---|---|
| 4,393,646 | 7/1983 | Lucchetta | 57/22 |
| 4,397,137 | 8/1983 | Davies et al. | 57/22 |
| 4,497,165 | 2/1985 | Vollm | 57/22 |
| 4,565,059 | 1/1986 | Mima | 57/22 |

FOREIGN PATENT DOCUMENTS

| | | | |
|---|---|---|---|
| 4734652 | 8/1972 | Japan | 57/22 |

*Primary Examiner*—Donald Watkins

*Attorney, Agent, or Firm*—Spensley Horn Jubas & Lubitz

[57] ABSTRACT

A yarn splicing nozzle unit in which ends of two yarns are spliced by applying compressed fluid thereon. A yarn splicing hole of the yarn splicing nozzle unit is divided in a axial direction thereof to form two yarn splicing chambers having their axes displaced from each other, a yarn inserting slit is formed commonly to the two yarn splicing chamber and compressed fluid jetting holes for jetting compressed fluid into the yarn splicing chambers are formed to an interior portion of the slit.

12 Claims, 16 Drawing Figures

YARN SPLICING NOZZLE UNIT

FIELD OF THE INVENTION AND RELATED ART STATEMENT

The present invention relates to a yarn splicing apparatus for splicing a spun yarn.

It is already known to splice ends of two yarns by causing compressed fluid to act upon end portions of the yarns which are put one on the other.

In particular, ends of two yarns are inserted in opposite directions into a yarn splicing hole, and compressed air is jetted into the yarn splicing hole to cause overlapping portions of the two yarn ends to oscillate or whirl so that fibers at the yarn end portions may be intermixed, twisted or intertwisted with one another to achieve splicing of the yarn ends.

A yarn splicing apparatus of such a conventional type has an advantage that a joint of yarns formed thereby is smaller than a conventional weaver's knot or a conventional fisherman's knot and has such a thickness of at the greatest 1 to 1.4 times of that of original yarns that the joint may not cause jamming in a subsequent knitting or weaving process. But there is a problem in strength of a joint of yarns. In fact, the strength of a joint of yarns which does not present a knot is increased by twisting the joint after fibers at ends of the two yarns have been intermixed and intertwisted sufficiently since frictional forces among the fibers are increased by such twisting of the joint.

Accordingly, when ends of yarns within a yarn splicing hole are acted upon by fluid, it is important to assure effective operations of promoting intertwisting of fibers at ends of individual yarns and twisting end portions of the yarns.

OBJECT AND SUMMARY OF THE INVENTION

It is an object of the present invention to propose a yarn splicing nozzle unit whereby fibers are well intertwined with one another to produce a joint having a high strength.

According to the present invention, a yarn splicing nozzle unit is provided wherein a yarn splicing hole is substantially divided in an axial direction thereof to form two yarn splicing chambers having their axes displaced from each other, and a yarn inserting slit is formed commonly to the two yarn splicing chambers while openings of compressed air jetting holes for jetting compressed fluid into the yarn splicing chambers therethrough are formed at wall faces adjacent the yarn splicing chambers near ends of yarns positioned to a most interior portion of the slit.

Ends of yarns which are inserted into the yarn splicing hole through the slit common to the yarn splicing chambers and put one on the other are positioned to the most interior portion of the slit, and jet flows from the compressed air jetting holes which are opened to the yarn splicing chambers hit directly upon the yarns in the position to intermix and intertwist fibers of the yarns efficiently and then to twist the yarns by an action of flows of fluid along side wall faces of the yarn splicing chambers to form a joint of the yarns.

DETAILED DESCRIPTION OF PREFERRED EMBODIMENTS

Now, a preferred embodiment of a yarn splicing nozzle unit according to the present invention will be described with reference to the accompanying drawings.

Figure 15:
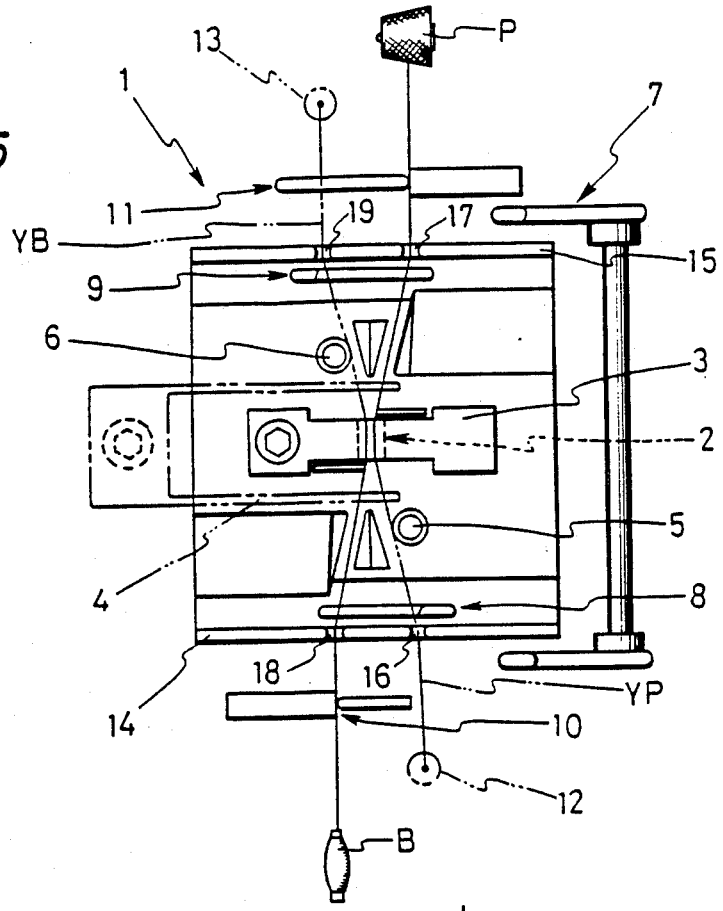
FIG. 15 a front elevational view showing general construction of an example of a yarn splicing apparatus.
Figure 16:
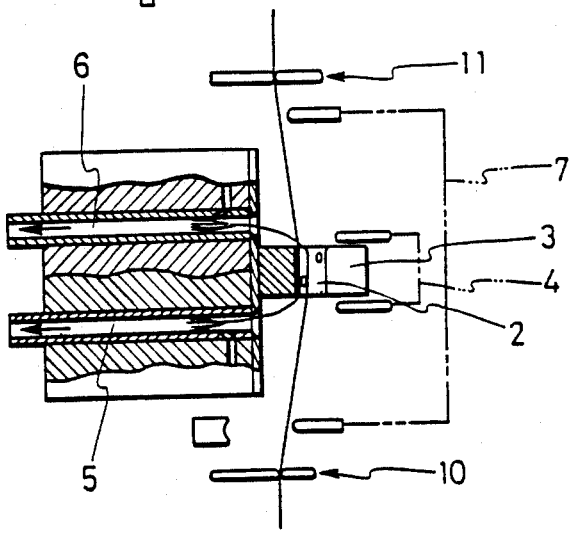
FIG. 16 a side elevational view, partly in section, of the yarn splicing apparatus of FIG. 15.

A general construction of an entire yarn splicing apparatus will first be described with reference to FIGS. 15 and 16. The yarn splicing apparatus denoted at 1 includes a yarn splicing member 3 in which a yarn splicing hole 2 is formed a yarn pressing device 4, a pair of yarn end untwisting nozzles 5 and 6, a yarn handling lever 7, a pair of yarn cutting devices 8 and 9, a pair of yarn clamping devices 10 and 11, and so on.

A yarn splicing operation is effected in a following sequence. In particular, where the yarn splicing apparatus is provided for a known automatic winder, a yarn YP on the side of a package P is first sucked into and held by a known suction mouth 12, and then the suction mouth 12 is pivoted to introduce the yarn YP on the package side to a position forwardly of the yarn splicing apparatus so that part of the yarn YP on the package side is clamped by the clamping device 10. Meanwhile, the clamping device 11 is pivoted to introduce a yarn YB on the side of a spinning bobbin B to the clamping device 11 by which the yarn YB on the spinning bobbin side is then clamped. After then, the yarn handling lever 7 is pivoted to introduce and insert the yarn YP on the package side into guide slits 16 and 17 in a pair of guide plates 14 and 15, respectively, and also into the yarn splicing hole 2 while the other yarn YB is introduced and inserted into guide slits 18 and 19 in the guide plates 14 and 15, respectively, and also into the yarn splicing hole 2. As a result, the two yarns YP and YB are positioned in a condition as illustrated in FIG. 15. Subsequently, the yarn cutting devices 8 and 9 are operated to cut the respective yarns YP and YB at positions spaced a predetermined distance from the clamped positions of the yarns YP and YB, and end portions of the yarns thus cut are sucked into the yarn end untwisting nozzles 5 and 6 so that they are acted upon by an untwisting operation by flows of compressed air jetted into the nozzles 5 and 6 in order to put the yarn end portions to a condition facilitating subsequent splicing thereof. In particular, the yarn end portions are untwisted to cause fibers thereof to extend in parallel relationship as in a thin. In this instance, the yarn putting aside lever 7 assumes a position retracted away from the yarns, and the yarn ends are thus sucked to the interior of the yarn untwisting nozzles 5 and 6 as seen in FIG. 16.

After completion of such a yarn untwisting operation, the yarn handling lever 7 is pivoted over a large extent toward the yarns, thereby drawing out the yarn ends from within the yarn untwisting nozzles 5 and 6 and placing, together with an operation of the yarn pressing device 4, extremity portions of the yarn ends one on the other within the yarn splicing hole 2. As a result, the yarn ends are set in position with their untwisted portions put one on the other.

Then, by an action of flows of compressed air jetted into the yarn splicing hole 2, splicing of the yarns is effected in a manner as described above.

Figure 5:
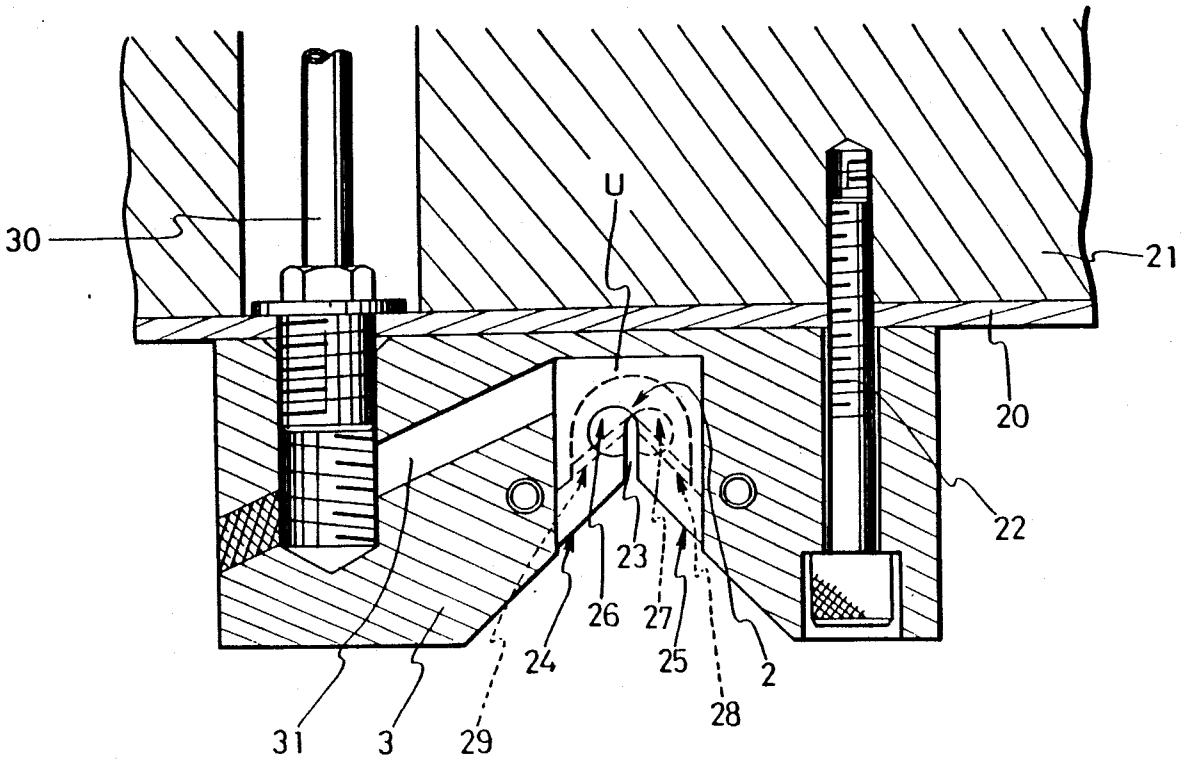
FIG. 5 a sectional plan view showing a relationship between a yarn splicing member and a nozzle unit.
Figure 6:
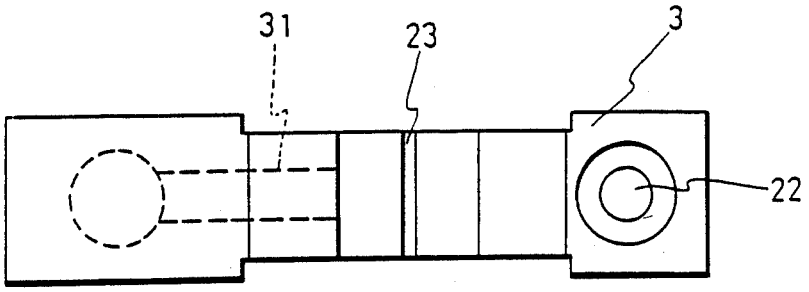
FIG. 6 a front elevational view of the relationship of FIG. 5.

The yarn splicing member 3 is illustrated in FIGS. 5 and 6. The yarn splicing member 3 is screwed 22 to a body bracket 21 with a front plate 20 interposed therebetween. The yarn splicing hole 2 is formed substantially at the center of the yarn splicing member 3, and a slit 23 suitable for inserting an external yarn into the yarn splicing hole 2 therethrough is formed over an entire extent of the yarn splicing hole 2 in its axial direction in a portion of the yarn splicing member 3 at which inclined wall faces 24 and 25 of the yarn splicing member 3 are to join.

The yarn splicing hole 2 is substantially divided into two by an imaginary plane perpendicular to the axis thereof, and first and second yarn splicing chambers 26 and 27 thus formed have their axes displaced from each other, and in the present embodiment, the axes of the yarn splicing chambers 26 and 27 are located in left and right symmetrical positions relative to the center of the slit 23. A pair of compressed air jetting nozzle holes 28 and 29 are perforated at positions of the yarn splicing chambers 26 and 27 as hereinafter described, and are opened in tangential relationship to inner circumferential faces of the yarn splicing chambers 26 and 27, respectively, so that air jetted into the yarn splicing chambers 26 and 27 may flow in opposite directions relative to each other. It is to be mentioned that compressed air is supplied from a compressed air supply pipe 30 to the nozzle holes 28 and 29 by way of supply paths formed in the yarn splicing member 3.

It is to be noted that the yarn splicing member 3 shown in FIG. 5 includes a removable yarn splicing nozzle unit U in which the yarn splicing chambers 26, 27, slit 23 and compressed air jetting nozzle holes 28 and 29 are formed. Thus, the yarn splicing nozzle unit can be replaced by another yarn splicing nozzle unit of a different shape and size depending upon a type, thickness or the like of yarns to be spliced.

A preferred embodiment of the yarn splicing nozzle unit U is illustrated in FIGS. 1 to 4. The first and second yarn splicing chambers 26 and 27 present a substantially circular cross section in a plane perpendicular to axes 32 and 33 thereof, respectively, with a distance l left between the parallel axes 32 and 33 thereof. The yarn inserting slit 23 is formed commonly to the yarn splicing chambers 26 and 27. One side wall 34 of the slit 23 continues in substantially tangential relationship to an inner circumferential face 35 of the first yarn splicing chamber 26 while the other side wall 36 of the slit 23 continues in substantially tangential relationship to an inner face 37 of the second yarn splicing chamber 27.

Meanwhile, the air jetting nozzle holes 28 and 29 which are opened in tangential relationship to inner circumferential wall faces of the yarn chambers 26 and 27 are actually opened at position such that ends of yarns positioned in the most interior of the slit 23 may directly be hit upon by compressed air jetted therefrom. In order words, the air jetting nozzle holes 28 and 29 are opened to joining portions of the side walls 34 and 36 of the slit 23 with the inner circumferential faces 35 and 37 of the first and second yarn splicing chambers 26 and 27, respectively. Thus, flows X1 and X2 of air jetted from the jetting holes 28 and 29 will intersect each other after they have come out of openings 38 and 39 of the jetting holes 28 and 29, respectively, as seen in a plan view of FIG. 1. Accordingly, ends of yarns placed one on the other in the yarn splicing hole 2 are positioned directly in front of the openings 38 and 39 and as a result acted upon by the strongest direct hitting actions of compressed air jetted from the openings 38 and 39.

Figure 1:
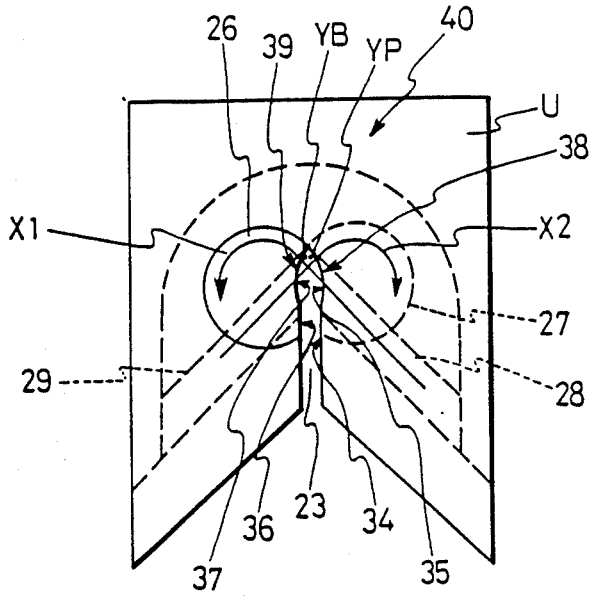
FIG. 1 is a plan view showing an embodiment of a yarn splicing nozzle unit according to the present invention.
Figure 2:
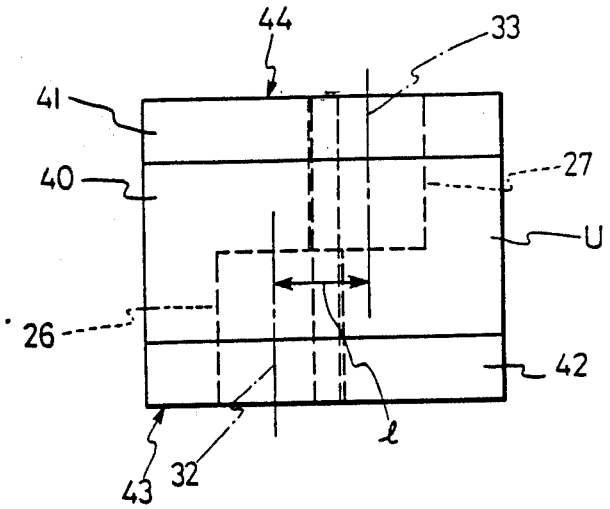
FIG. 2 a rear elevational view of the yarn splicing nozzle unit of FIG. 1.
Figure 3:
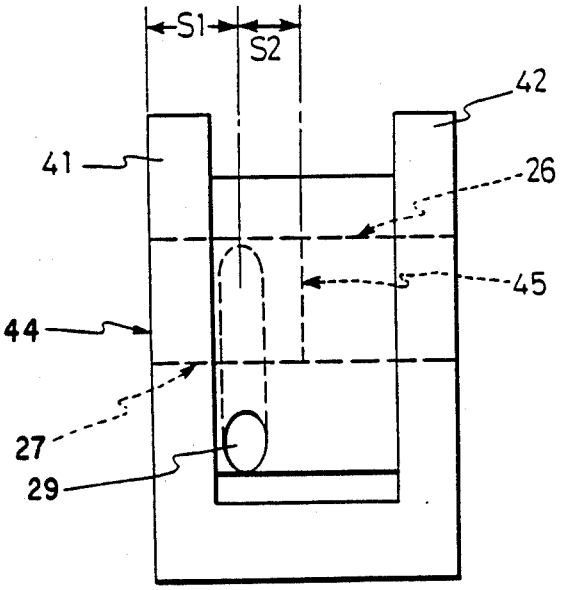
FIG. 3 a left-hand side elevational view of the yarn splicing nozzle unit of FIG. 1.
Figure 4:
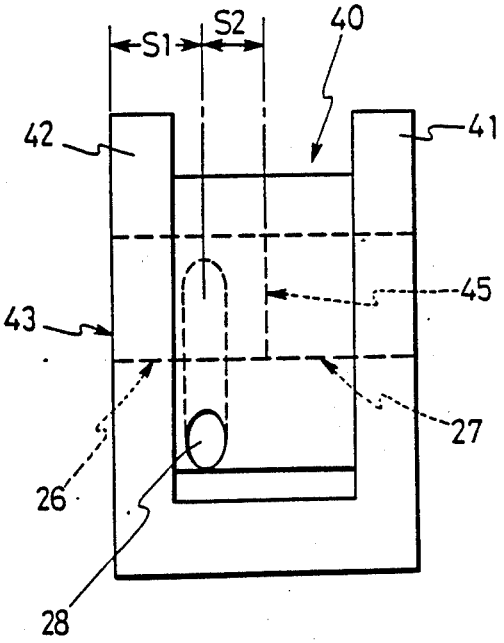
FIG. 4 a right-hand side elevational view of the yarn splicing nozzle unit of FIG. 1.

It is to be noted that air jetted from the jetting holes 28 and 29 will form flows whirling in opposite directions relative to each other as seen in FIG. 1, and in the present embodiment where the peculiar twist of yarns to be spliced is selected to be the Z twist, the whirling flows X1 and X2 flow in directions to untwist the parent yarns located in the yarn splicing chambers 26 and 27, respectively. In particular, referring to FIGS. 1 and 2, if it is assumed that the first yarn splicing chamber 26 is located adjacent a package (8 in FIG. 15) while the second yarn splicing chamber 27 is located adjacent a spinning bobbin B, the whirling flow X1 in the first yarn chamber 26 flows in a direction to untwist a parent yarn connecting to the package while the whirling flow X2 in the second yarn splicing chamber 27 flows in a direction to untwist a parent yarn connecting to the spinning bobbin. Accordingly, a joint of the yarns formed by the whirling flows will have a twist in the same direction with the parent yarns, and particularly in the present embodiment, a joint having an actual Z twist will be formed.

The nozzle unit U has a closed air path 40 formed therein which is defined by a pair of flanges 41 and 42 of the nozzle unit U and also by a side wall of the yarn splicing member when the yarn splicing member is set in position. The air path 40 communicates with the supply path 31 of the yarn splicing member 3 shown in FIG. 5.

It is to be noted that while the compressed air jetting holes 38 and 39 opened to the yarn splicing chambers 26 and 28, respectively, have a circular cross sectional shape in a plane perpendicular to flows of air therein, it is otherwise possible that they have either an elliptical cross sectional shape or a flattened cross sectional shape elongated in an axial direction of the yarn splicing chambers. The positions of the openings 38 and 39 in the axial direction are spaced by a distance S1 from end faces 43 and 44 of openings of the splicing chambers 26 and 27 and spaced also by the distance S2 from a boundary plane 45 between the yarn splicing chambers 26 and 27, respectively, and here $S1 \geqq S2$. In other words, the positions of the openings 38 and 39 are preferably either at the centers of the yarn splicing chambers 26 and 27 or displaced toward the boundary plane 45 between the yarn splicing chambers 26 and 27 from the centers of the yarn splicing chambers 26 and 27, respectively.

Figure 7:
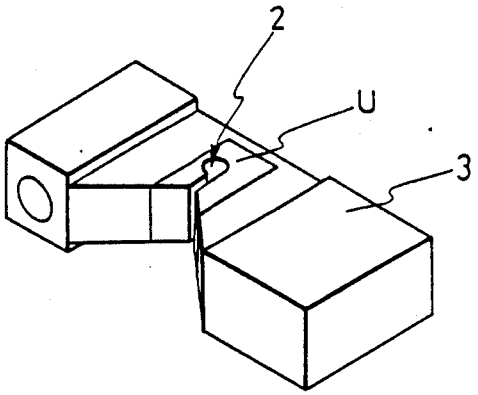
FIG. 7 a perspective view of the relationship of FIG. 5.
Figure 8:
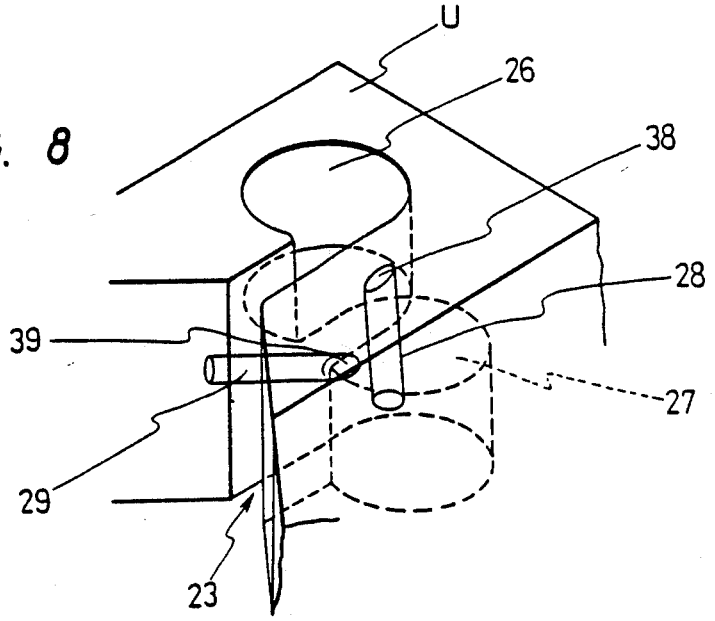
FIG. 8 a perspective view showing a relationship between yarn splicing chambers.

FIGS. 7 and 8 are perspective views for facilitating understandings of shapes and an arrangement of the yarn splicing chambers 26 and 27 and an arrangement of the compressed air jetting holes 28 and 29.

Now, behaviors of individual yarn ends upon splicing thereof by the yarn splicing apparatus will be described with reference to FIG. 9. In particular, individual yarn ends are positioned to positions as indicated by block dots YP and YB in FIG. 1 by actions of the yarn handling lever 7 and the yarn pressing device 4 shown in FIGS. 15 and 16.

Figure 9:
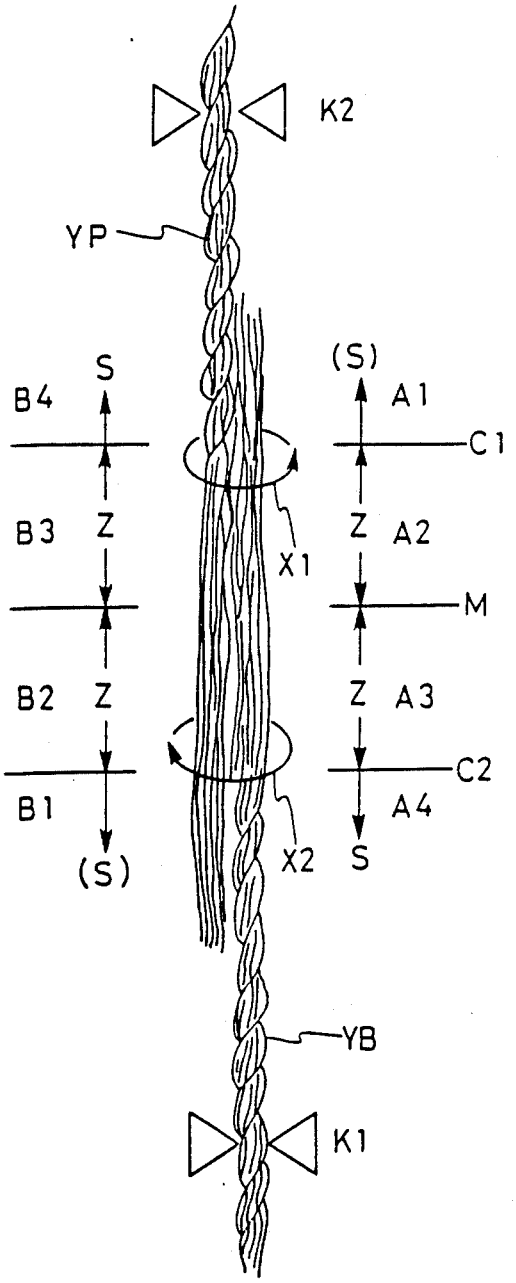
FIG. 9 a diagrammatic illustration showing a principle of splicing yarns.

In particular, referring to FIG. 9, two yarn ends YP and YB provided by cutting a single yarn are put one on the other in parallel or intersecting relationship so as to direct in opposite directions with extremity portions thereof untwisted in preparation for subsequent yarn splicing.

The untwisted portions of the yarn ends have either a substantially zero peculiar twist or a less twist than its peculiar twist, and preferably the untwisted portions have no twist so that fibers constituting the yarns extend substantially in parallel relationship.

Besides, the extremity portions of the ends of the yarns YP and YB are in a free condition without being restricted by any element while portions of the yarns YP and YB spaced a predetermined distance from the extremities of the same are clamped. Thus, twisting will not propagate beyond such clamped points K1 and K2, which thus provide fixed points.

In this condition, the two yarns YP and YB are whirled in different directions X1 and X2 at two different positions within an overlapping range of the yarns YP and YB.

In particular, the whirling directions depend upon the direction of the peculiar twist of the yarns to be spliced. Thus, the whirling direction at the position C1 is selected to be a direction X1 to untwist the peculiar twist of the yarn YP between the clamped point K2 of the yarn YP and the twisting point C1 of the same by such whirling while the whirling direction at the position C2 is selected to be a direction X2 to untwist the peculiar twist of the yarn YB between the clamped point K1 of the yarn YB and the twisting point C2 of the same by the whirling. The yarns YP and YB shown have a peculiar twist in the Z direction, and on the contrary where yarns have a peculiar twist in the S direction, the whirling directions X1 and X2 are reversed.

Behaviors of yarns caused by the whirling action as described above will be described below.

Now, a portion of the yarn YB from the clamped point K1 to the extremity of the end is divided into four sections A1 to A4 for convenience of description.

In particular, the section A1 is a section from the whirl applying point C1 to the extremity of the yarn end, the section A2 is another section from the whirl applying point C1 to a mid position M between the whirl applying points C1 and C2, the section A3 is a further section from the mid point M to the whirl applying point C2, and the section A4 is a yet another section from the whirl applying point C2 to the clamped point K1. The yarn YP is also divided into four sections B1 to B4 in a similar manner from the extremity of the end thereof.

Thus, whirling of the yarn YB in the direction of an arrow mark X1 at the whirl applying point C1 additionally twist the yarn YB in the Z direction while the yarn YB is wound in the Z direction around the yarn YP.

A similar condition appears also by whirling of the yarn YP in the direction of an arrow mark X2 at the whirl applying point C2, and since the end B1 of the yarn YP is in a free condition, the Z twist is provided to the section B2 of the yarn YP, and fibers in the sections B1 and B2 are intertwisted and united with fibers of the yarn YB thereby to form a single contiguous yarn having a twist in the Z direction.

Accordingly, the end sections Al and A2 of the yarn YB which are located adjacent the whirl applying point C1 with reference to the mid point M between the whirl applying points C1 and C2 are intertwisted with the sections B4 and B3 of the yarn YP, respectively, while they are being twisted in the same direction as the peculiar twisting direction to the yarn YB, and the end sections B1 and B2 adjacent the whirl applying point C2 with reference to the mid point M are intertwisted with the sections A4 and A3 of the yarn YB, respectively, while they are being twisted in the same direction as the peculiar twisting direction to the yarn YP. Accordingly, a twist in the same direction as the parent yarn twisting direction is provided over an entire extent of a joint thus formed. Thus, a joint of yarns after splicing of the latter will have a similar structure as the parent yarns depending upon an untwisted condition at an overlapping range of the yarn ends before splicing.

Figure 10:
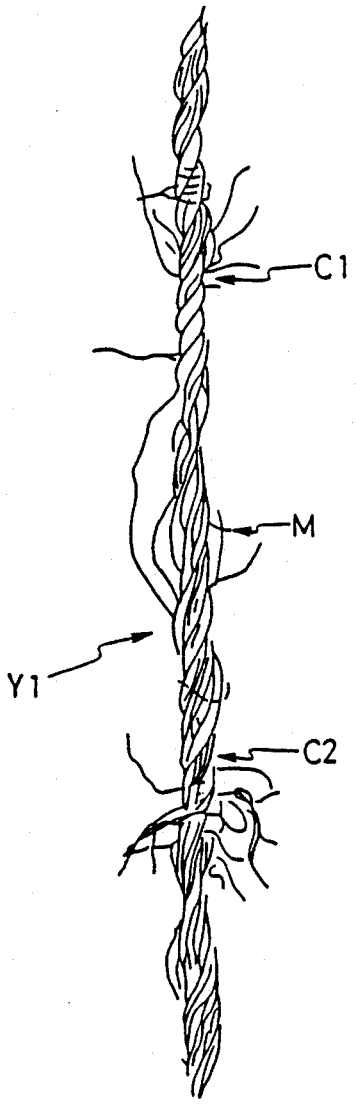
FIG. 10 a diagrammatic illustration showing an example of a joint of yarns obtained by the nozzle unit of FIG. 1.

A joint of yarns produced in this manner is illustrated in FIG. 10. FIG. 10 is a diagrammatic illustration of a joint of yarns where individual yarn ends are untwisted over an entire overlapping range thereof. From FIG. 10, it can be observed that a joint Y1 of yarns is in the form of part of a single yarn having an actual twist (Z twist) in the same direction over an entire extent of the joint Y1, and the two parent yarns cannot be distinguished from each other with fibers of the individual yarn ends intermixed with each other to form a united single twisted yarn. In this case, a joint of a high quality is produced wherein characteristics thereof are little inferior to those of a single parent yarn.

Besides, the joint has no antenna which projects therefrom at opposite extremities of the yarn ends.

It is to be noted that, depending upon controlling plates provided adjacent opposite openings of the yarn splicing hole 2, the yarn splicing apparatus described above can act as a yarn splicing apparatus which is very convenient for both of a short fiber spun yarn wherein fibers constituting the yarn have an average fiber length of 30 to 50 mm and a long fiber spun yarn wherein fibers have an average fiber length of 50 to 100 mm.

Figure 11:
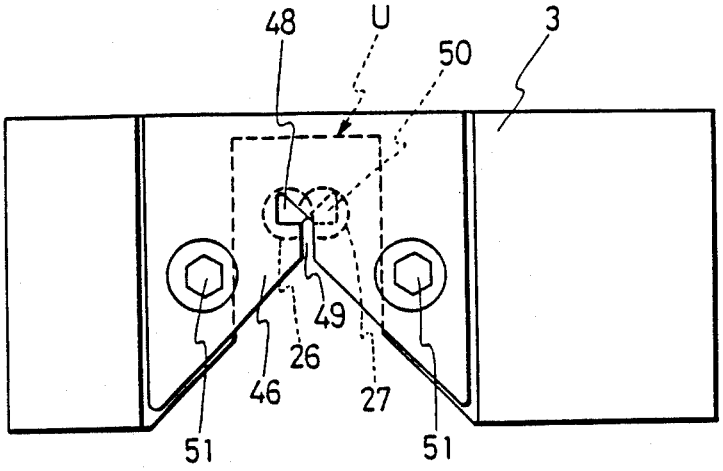
FIG. 11 a plan view showing a relationship between controlling plates for long fibers and the nozzle unit.
Figure 12:
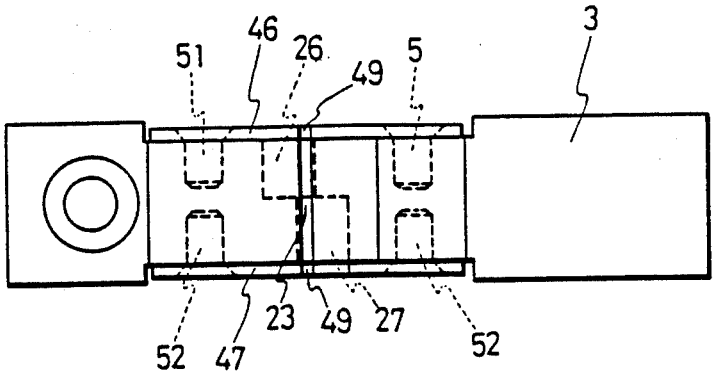
FIG. 12 a front elevational view showing the relationship of FIG. 11.

FIGS. 11 and 12 illustrate a yarn splicing nozzle unit which includes a pair of controlling plates 46 and 47 for long fibers. The controlling plates 46 and 47 are screwed 51 and 52 adjacent openings of a pair of yarn splicing chambers 26 and 27, respectively, and each have a substantially triangular opening 48 or 50 and a slit 49 formed therein. The openings 48 and 50 have an area smaller than the sectional area of the yarn splicing chambers 26 and 27 and promote intertwisting of fibers rather than whirling of fibers. In particular, in the yarn splicing chambers, turning forces of individual yarn ends are controlled so that intermixing and intertwisting of fibers take precedence over winding of fibers. On the other hand, extremity portions of ends of yarns outside the yarn splicing chambers 26 and 27 are whirled in predetermined directions due to the non-circular openings 48 and 50, and hence the winding direction of fibers becomes fixed relative to the parent yarns so that fibers will be wound around the parent yarns without producing an antenna of a yarn end.

Figure 13:
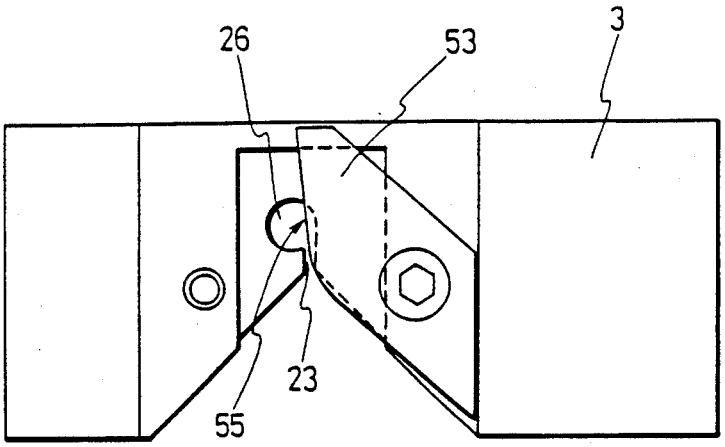
FIG. 13 a plan view showing a relationship between controlling plates for short fibers and the nozzle unit.
Figure 14:
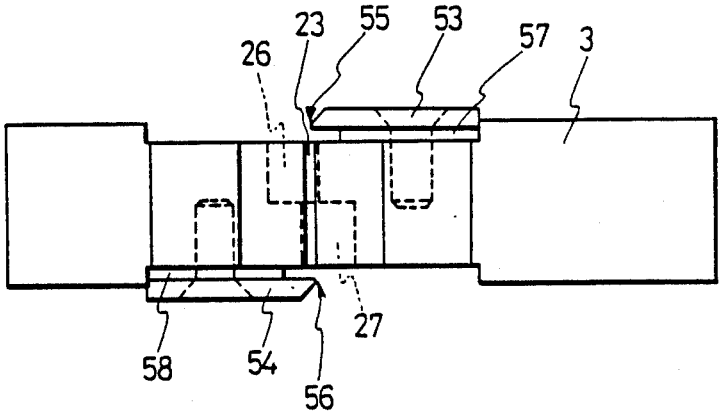
FIG. 14 a front elevational view showing the relationship of FIG. 13.

FIGS. 13 and 14 illustrate a yarn splicing nozzle unit which includes a pair of controlling plates 53 and 54 which are suitable for short fibers and are mounted via spacers 57 and 58. In particular, the controlling plates 53 and 54 in the present arrangement have such a shape that a side edge 55 or 56 crosses part of an opening of a yarn splicing chamber 26 or 27. Thus, distinct from the controlling plates 46 and 47 described above, the controlling plates 53 and 54 are constituted to strengthen whirling forces to yarns within the yarn splicing chambers to increase winding fibers to obtain the strength of a joint of yarns.

Accordingly, the side edges 55 and 56 of the controlling plates 53 and 54 act to position ends of yarns when they are inserted and to control flows of air to flow out in directions toward the openings from the yarn splicing chambers 26 and 27 so as to wind a yarn end outside the yarn splicing chambers around the other yarn.

Exemplary results of experiments in strength of joints of yarns obtained by the yarn splicing nozzle unit described above are shown below.

| | Parent Yarn | Joint | Retaining Ratio (%) |
|---|---|---|---|
| | (a) Wool | Nm 28 (long fiber) | |
| Number of Samples | 30 | 30 | |
| Maximum (g) | 278.0 | 250.0 | |
| Minimum (g) | 152.0 | 157.0 | |
| Average (g) | 217.5 | 209.3 | 96.2 |
| Coefficient of Fluctuation (%) | 16.6 | 12.2 | |
| | (b) Cotton | Ne 30 | |
| Number of Samples | 30 | 30 | |
| Maximum (g) | 286.0 | 284.0 | |
| Minimum (g) | 205.0 | 200.0 | |
| Average (g) | 244.0 | 236.4 | 96.9 |
| Coefficient of Fluctuation (%) | 7.0 | 8.1 | |

It is to be noted that in the experiments described above, the pressure of air supply to the yarn splicing nozzles is 5.5 kg/cm$^2$, and in this manner, yarn splicing is possible at a relatively low pressure.

As apparent from the foregoing description, according to the present invention, a yarn splicing nozzle unit can be obtained wherein fibers can be intertwisted with one another whether they are long fibers or short fibers, and hence a joint of yarns having a high strength can be obtained.

What is claimed is:

1. A yarn splicing nozzle unit comprising:

a yarn splicing hole substantially divided in an axial direction thereof to form two yarn splicing chambers having their axes displaced from each other, a yarn inserting slit formed commonly to said two yarn splicing chambers over the entire extent of said yarn splicing hole, and compressed air jetting holes for jetting compressed fluid into said yarn splicing chambers formed near an interior portion of said slit.

2. A yarn splicing nozzle unit in which ends of two yarns are spliced by applying compressed fluid thereon, comprising:

a yarn splicing hole having two yarn splicing chambers which have axes displaced from each other, a yarn inserting slit formed commonly to extend over said two yarn splicing chambers, compressed fluid jetting holes which open within said yarn splicing chambers for jetting compressed fluid into said yarn splicing chambers, wherein said first and second yarn splicing chambers have a substantially circular cross section in a plane perpendicular to the axes thereof and have similar cylindrical shapes, said axes being in parallel to the yarn inserting slit, wherein the first side wall of the yarn inserting slit continues in substantially tangential relationship to an inner circumferential face of the first yarn splicing chamber and the second side wall of the yarn inserting slit continues in substantially tangential relationship to an inner circumferential face of the second yarn splicing chamber, and wherein the fluid jetting holes of the first and second yarn splicing chambers are opened at positions such that the first and second side walls of the slit continue to the inner faces of the first and second yarn splicing chambers, respectively, and are disposed in an interior portion of the slit.

3. A yarn splicing nozzle unit as claimed in claim 2, wherein said fluid jetting holes are opened in tangential relationship to the inner circumferential wall faces of the first and second yarn splicing chambers, respectively, and fluid jetted from the jetting holes forms flows whirling in opposite directions relative to each other to untwist the peculiar twists of parent yarns located in the yarn splicing chambers.

4. A yarn splicing nozzle unit as claimed in claim 3, wherein the position of the opening of each of the fluid jetting holes in an axial direction of the yarn splicing chamber is either at the center of the yarn splicing chamber or is displaced toward a boundary plane between the first and second yarn splicing chambers from the center of the yarn splicing chamber.

5. A yarn splicing nozzle unit as claimed in claim 3, wherein at least one of the compressed fluid jetting holes has a substantially circular cross sectional shape in a plane perpendicular to the direction of flow of fluid therein.

6. A yarn splicing nozzle unit as claimed in claim 3, wherein at least one of the compressed fluid jetting holes has a substantially elliptical cross sectional shape in a plane perpendicular to the direction of flow of fluid therein.

7. A yarn splicing nozzle unit as claimed in claim 3, wherein at least one of the compressed fluid jetting holes has a substantially flattened cross sectional shape in a plane perpendicular to the direction of flow of fluid therein.

8. A yarn splicing nozzle unit in which ends of two yarns are spliced by applying compressed fluid thereon, comprising:

a yarn splicing hole having two yarn splicing chambers which have axes displaced from each other, a yarn inserting slit common to and extending over said two yarn splicing chambers, and compressed fluid jetting holes which open within said yarn splicing chambers and through which compressed fluid may be jetted into said yarn splicing chambers, wherein at least one controlling plate having a substantially triangular opening for covering one of the openings of the yarn splicing chambers and a slit for positioning over the side face of the yarn splicing slit of the yarn slicing nozzle unit is mounted adjacent an opening of one of the yarn splicing chambers, whereby intertwisting of long fibers constituting a spun yarn is promoted.

9. A yarn splicing nozzle unit in which ends of two yarns are spliced by applying compressed fluid thereon, comprising:

a yarn splicing hole having two yarn splicing chambers which have axes displaced from each other, a yarn inserting slit common to and extending over said two yarn splicing chambers, and compressed fluid jetting holes which open within said yarn splicing chambers and through which compressed fluid may be jetted into said yarn splicing chambers, wherein a pair of controlling plates having a shape such that a side edge of the plate crosses part of an opening of the yarn splicing chamber are mounted adjacent openings of the yarn splicing chambers via spacers, whereby whirling forces which are applied to yarns within the yarn splicing chambers are strengthened to thereby increase the winding of short fibers constituting a spun yarn.

10. A nozzle unit comprising:

a first yarn splicing chamber and a second yarn splicing chamber, said first and second yarn splicing chambers being offset axially from one another;

a yarn inserting slit in communication with said first yarn splicing chamber and said second yarn splicing chamber, said yarn inserting slit having a first wall extending substantially tangentially to the inner surface of the first yarn splicing chamber and a second wall extending substantially tangentially to the inner surface of the second yarn splicing chamber;

at least one jetting nozzle for introducing compressed fluid into one of said yarn splicing chambers, said jetting nozzle extending substantially tangentially to the inner surface of said yarn splicing chamber.

11. A nozzle unit comprising:

a first yarn splicing chamber and a second yarn splicing chamber, said first and second yarn splicing chambers being offset axially from one another;

a yarn inserting slit in communication with said first yarn splicing chamber and said second yarn splicing chamber;

at least one jetting nozzle for introducing compressed fluid into at least one of said yarn splicing chambers.

12. A nozzle unit comprising:

a first yarn splicing chamber and a second yarn splicing chamber, said first and second yarn splicing chambers being offset axially from one another;

a yarn inserting slit in communication with said first yarn splicing chamber and said second yarn splicing chamber, said yarn inserting slit having a first wall extending substantially tangentially to the inner surface of the first yarn splicing chamber and a second wall extending substantially tangentially to the inner surface of the second yarn splicing chamber;

a first jetting nozzle for introducing compressed fluid into said first yarn splicing chamber, said first jetting nozzle extending substantially tangentially to the inner surface of said first yarn splicing chamber; and a second jetting nozzle for introducing compressed fluid into said second yarn splicing chamber, said second jetting nozzle extending substantially tangentially to the inner surface of said second yarn splicing chamber.

* * * * *